United States Patent [19]

Skach, Jr. et al.

[11] Patent Number: 4,765,830

[45] Date of Patent: Aug. 23, 1988

[54] INJECTABLE REAGENTS FOR MOLTEN METALS

[75] Inventors: Edward J. Skach, Jr., Freeport; David W. Brake, West Columbia; Joseph H. Waibel, Lake Jackson, all of Tex.

[73] Assignee: The Dow Chemical Company, Midland, Mich.

[21] Appl. No.: 76,569

[22] Filed: Jul. 22, 1987

Related U.S. Application Data

[62] Division of Ser. No. 899,859, Aug. 25, 1986, Pat. No. 4,708,737.

[51] Int. Cl.[4] ..... C21C 7/02

[52] U.S. Cl. ..... 75/53; 75/58

[58] Field of Search ..... 75/53, 58

[56] References Cited

U.S. PATENT DOCUMENTS

| | | | |
|---|---|---|---|
| 3,492,114 | 1/1970 | Schneider | 75/53 |
| 3,501,291 | 3/1970 | Schneider | 75/53 |
| 3,801,303 | 4/1974 | Kotler et al. | 75/58 |
| 3,885,956 | 5/1975 | Obst et al. | 75/53 |
| 3,957,502 | 5/1976 | Cull et al. | 75/53 |
| 3,998,625 | 12/1976 | Koros | 75/53 |
| 4,040,818 | 8/1977 | Clegg | 75/53 |
| 4,137,072 | 1/1979 | Kawakami et al. | 75/58 |
| 4,139,369 | 2/1979 | Kandler | 75/53 |
| 4,182,625 | 1/1980 | Baker et al. | 71/105 |
| 4,209,325 | 6/1980 | Cooper et al. | 75/58 |
| 4,279,643 | 7/1981 | Jackman | 75/53 |
| 4,401,465 | 8/1983 | Neelameggham | 75/53 |
| 4,435,210 | 3/1984 | Hiookawa | 75/53 |
| 4,705,561 | 11/1987 | Green | 75/58 |

*Primary Examiner*—Peter D. Rosenberg
*Attorney, Agent, or Firm*—Walter J. Lee

[57] ABSTRACT

Injectable reagents useful for innoculating molten process metals, such as molten iron, are prepared by effecting an impregnation of a minor amount of a molten metal reagent, such as Mg or Al or alloys of these, into small particles of a major amount of an inorganic reagent, such as alkaline earth metal oxides and/or carbides, and freezing the molten metal reagent, thereby obtaining particles of the inorganic reagent permeated with metal reagent.

8 Claims, No Drawings

INJECTABLE REAGENTS FOR MOLTEN METALS

CROSS-REFERENCE TO RELATED APPLICATION

This is a divisional of application Ser. No. 899,859, filed Aug. 25, 1986, now U.S. Pat. No. 4,708,737.

FIELD OF THE INVENTION

Magnesium-containing and/or aluminum-containing injectable reagents for molten metals.

BACKGROUND OF THE INVENTION

Magnesium is well known as an injectable for molten metals, in some cases as an alloying agent, or as a deoxidizer, or as a desulfurizer, or in some cases as a nodularizer. Aluminum has also been used as an injectable for molten metals, especially as an aid for a calcium compound, e.g. lime, which is used as a desulfurizing agent for molten iron. Calcium metal may be used in place of the magnesium metal, but it is not cost-competitive with Mg or Al.

It is known that Mg powder or Al powder can be used along with a calcium compound, e.g. lime, by being injected into molten iron either as a physical mixture with a particulate Ca compound or by staged successive injections of the Mg or Al with the Ca compound.

U.S. Pat. No. 4,137,072 discloses a molded pellet form of a mixture of at least one metal selected from Mg, Ca, and Al and at least one metal oxide selected from MgO, CaO, and $Al_2O_3$. Preference for Mg +MgO is shown. The use of an organic polymer binding material as an optional ingredient in the mixture is disclosed.

U.S. Pat. No. 4,139,369 discloses a mixture of Mg powder with CaO, $CaCO_3$, $CaC_2$, or $CaMg(CO_3)_2$, wherein the Ca compound has a particle size of 0.06 to 3 mm and the Mg particles have a size of 0.060 to 0.095 mm.

U.S. Pat. No. 4,173,466 discloses compacted tablets of particulate magnesium, calcium, and iron in which the iron is the predominant ingredient.

U.S. Pat. No. 4,182,626 discloses a staged mixing process for combining pulverulent Mg metal with fine particle alkaline earth metal compounds.

U.S. Pat No. 4,209,325 discloses a mixture of alkaline earth metal with sintered lime which contains at least one fluxing agent, said fluxing agent being, e.g. alumina, alkali metal fluoride, alkaline earth metal fluoride, or sodium carbonate.

U.S. Pat. No. 4,586,955 discloses the use of Al metal powder with lime to desulfurize hot metal in a ladle.

U.S. Pat. No. 4,559,084 and U.S. Pat. No. 4,421,551 disclose salt-coated Mg granules for use in desulfurizing molten iron.

Despite the general successes in using Mg or Al particles along with such things as CaO and $CaC_2$ as injectables in molten process metal, e.g. molten iron, there remains a need in the industry for an injectable reagent which does not create excessive, unwanted splashing of the molten process metal as the injectables are undergoing reaction therein, is uniform in composition, is more easily and safely handled, and is non-segregating during shipping, storage, and handling.

SUMMARY OF THE INVENTION

The novel injectable reagents of the present invention are prepared by effecting a permeation of molten Mg or Al metal, or alloys thereof (i.e. "metal reagents") into at least one particulate, non-molten, inorganic, alkaline earth metal reagent compound such as CaO, $CaC_2$, MgO, $CaAl_2O_4$, dolime or mixtures of these, or, e.g., $Al_2O_3$, and the like, under conditions wherein the amount of the molten metal reagent does not exceed the amount of particulate inorganic reagent material. A substantially inert atmosphere, esp. argon, is maintained in some instances as long as the Mg or Al is hot to prevent reaction with air.

One process for effecting the permeation of the molten metal reagent into the particulate, inorgaric reagent material comprises physically adding the molten metal reagent, preferably with stirring, to the inorganic reagent material whereby the molten metal reagent permeates the inorganic reagent particles. Another process comprises blending particulate Mg or Al metal, or alloys thereof, (i.e. "metal reagent") with the particulate inorganic reagent material in the desired ratios, then heating the mixture to melt the metal reagent, thereby effecting permeation of the molten metal reagent into the non-molten inorganic reagent material.

After the molten metal reagent has permeated the particulate inorganic reagent material, the mixture is cooled to freeze the metal in place in the inorganic particles. If any of the particles are adhered together by the presence of metal reagent on the surface of the particles, one may, if desired, grind the particles to obtain a free-flowing particulate product.

The novel injectables of this invention are characterized as particulate inorganic materials (more fully described hereinafter) impregnated with Mg or Al metal or alloys thereof, in which the particulate inorganic material comprises the majority of the total weight.

DETAILED DESCRIPTIONS, INCLUDING BEST MODE

For purposes of conciseness and ease of description the following terminology is used in some of these descriptions:

1. "Metal reagent" refers to the Mg metal or Al metal, or alloys of these, employed in the "injectable reagent";
2. "particulate inorganic reagent" refers to the particulate inorganic alkaline earth metal compound(s) and/or aluminum compound(s) into which the "metal reagent" is impregnated;
3. "impregnated" is used synonymously with "permeated" and "imbibed" to indicate a "soaking-in" effect;
4. "injectable reagent" refers to the "particulate inorganic reagent" into which the "metal reagent" has been impregnated, said "injectable reagent" being useful as an injectable for molten process metal; it is actually a composite of the metal reagent and inorganic reagent;
5. "process metal" is the metal into which the injectable reagent is injectable.

The novel injectable reagents of this invention comprise particulate inorganic reagents impregnated with metal reagent, said impregnation having been effected by an imbibing or permeating of molten metal reagent into particulate inorganic reagent, followed by freezing of said metal reagent, said impregnation being effected, in some instances, in an environment which is substantially devoid of extraneous reactive atmosphere such as air (oxygen, moisture). Argon is the preferred atmosphere and is readily available. $CaC_2$ does not appear to promote the oxidation of the metal reagent, thus when the only inorganic reagent being used is $CaC_2$, then argon is not usually necessary and ambient air can be used, but too much moisture can be detrimental and is best avoided.

The impregnation of metal reagent may be effected by mixing molten metal reagent into non-molten particulate inorganic reagent, followed by freezing, and, if needed to break up clusters of adhered particles, grinding to obtain the preferred particulate form. For best results, the inorganic reagent should be pre-heated to above the melting point of the metal reagent so as to avoid having the molten metal reagent freeze before being well-mixed.

It is generally preferred, however, that impregnation of metal reagent into particulate inorganic reagent be effected by blending particulate metal reagent with particulate inorganic reagent, then heating to a temperature sufficient to melt the metal reagent, but not the inorganic reagent, thereby effecting impregnation of the metal reagent into the inorgaric reagent, then cooling to freeze the metal. Here also, extraneous reactive atmosphere, such as air, especially while the metal reagent is hot, should, in some instances, be avoided by using an inert atmosphere such as argon. Some re-grinding may be needed to break up clusters of particles.

Each of the above described processes for making the present novel injectable reagents have features which may commend it in certain circumstances. For instance, if it is desired to use metal reagent which is already available in molten form, such as at the point of manufacture of the metal or its alloy, one may, on balance, economize by mixing the already molten metal into the particulate inorganic reagent. However if the available metal reagent is not already molten, it is preferred to mix the non-molten metal in particulate form with the particulate inorganic reagent prior to melting the metal to obtain the impregnation; by this method a uniform mixture is substantially obtained prior to melting the metal and the time required at molten temperature is shortened, thus economizing on energy. Furthermore, by pre-mixing the reagents in solid, particulate form, a more homogeneous product can be obtained, especially throughout a large batch.

If one mixes a small amount of molten metal reagent into a batch of particulate inorganic reagent, then some of the inorganic particles are likely to be thoroughly permeated by the molten metal reagent while other particles may imbibe little or none of the molten metal reagent. The particles, when well-mixed, will comprise a uniform blend, but not a homogeneous batch. A uniform blend of particles is operable, but a homogeneous batch of particles is preferred.

The metal reagents comprise Mg metal, Al metal, or alloys of these, especially Mg metal or its alloys.

The particulate inorganic reagents comprise alkaline earth metal compounds and/or aluminum compounds which are substantially stable during the process of preparing the injectable reagent of this invention. There may be some reaction during said process if any extraneous reactants, such as air or moisture, accompany the inorganic reagent and for this reason it is preferable to pre-heat the inorganic reagent compound prior to combining it with the metal reagent, thus driving out air, moisture, or other volatile extraneous material which can react with the metal reagent and reduce the effectiveness of the metal reagent. It is desirable to retain the reactivity effectiveness of the metal reagent throughout the formation of the injectable reagent so that the reactivity of the metal reagent desired during the molten process metal treatment is preserved until that time. Thus, during the permeation of the metal reagent into the particles of inorganic reagent it is desired that there be little or no chemical reaction occuring, other than release of whatever volatile materials that may be present. If one is aware, however, that some air (oxygen) or moisture may be present, one may add enough excess of the metal reagent to allow for some of it to be converted to MgO or $Al_2O_3$, thus increasing the amount of the inorganic reagent.

Mixing of the particulate metal reagent and the particulate inorganic reagent may be done in mixers designed to provide mixing of dissimilar solid particles or mixing a liquid with a particulate solid. Heated rotating vessels may be used which are operated at a temperature high enough to melt the metal reagent. It is within the skill of practitioners of the art of such mixing to select, or design, vessels of a type and size suitable for their particular needs including, if needed, the provision of an inert gas pad or purge in the vessel. Pre-mixing of metal particles and inorganic particles may be done at a temperature below the melting temperature of the metal particles and then conveyed into a heated mixer wherein the metal is melted, thereby effecting permeation of the molten metal into the inorganic particles.

The present injectable reagents are variously useful in molten process metals (esp. those melting above about 950° C.) which variously require deoxidation, desulfurization, graphite nodularization, or silicon-content modification. The reagents are especially useful as deoxidation or desulfurization reagents for molten ferrous metals. The amount of the reagents required in a given application will be determined by the operator of the process metal treating process.

The present injectable reagents, generally being in particulate form of a size small enough to fall through an 8-mesh screen (U.S. Standard Sieve Size), preferably through a 40-mesh screen, most preferably through a 100-mesh screen, may be injected into the molten process metal through a lance in a carrier stream of inert gas (e.g., nitrogen or argon) or by the wire injection technique. The wire injection technique involves packing of the injectable reagent into a small diameter hollow tube of a metal which dissolves in the process metal. For instance, for molten iron (or steel) desulfurization a thin-walled, small-diameter hollow tube of iron (or steel) filled with the injectable reagents would be inserted into the molten iron at a rate controlled by the operator of the process which has been determined as the rate needed to obtain the desired results. Injection by way of a lance or as a wire are well known in the metal processing industry and further explanation here should not be needed. Also the temperature at which the molten process metal should be processed is determined by the operator of the process.

The temperature at which the molten metal reagent is impregnated into the inorganic reagent must, of course, be at or above the melting point of the metal reagent and, preferably, should not very closely approach the boiling point which, because of the significant vapor pressure of the metal, can cause loss of the metal reagent into the atmosphere. The melting point of Mg metal is about 650° C. and the melting point of Al is about 660° C. The boiling points of the various alloys of Mg and Al are found in various texts and publications. We have found that a temperature range of 800°-900° C. provides a low viscosity, but not too vaporous, Mg.

In the case of Mg, for example, if used in a manner in which the Mg is the major ingredient in contact with a portion of CaO reagent, such as when molten Mg is added to a batch of CaO reagent, the temperature must be kept above 715° C. to avoid formation of Mg.Ca alloy. So long as the injectable reagent is prepared in such a manner that the CaO reagent is the major ingredient and the molten Mg is the minor ingredient, then the formation of Mg.Ca alloy is avoided, even at molten Mg temperatures below 715° C.

Thus the CaO comprises a major amount (more than 50%) and the Mg comprises a minor amount (less than 50%) of the total weight of the injectable reagent; prefereably the Mg is an amount up to about 45% by weight, more preferably an amount in the range of about 5% to about 40%, most preferably about 25% to about 35%.

The impregnation of molten metal reagent into the inorganic reagent works better with high porosity particles than with low porosity (i.e. densified) particles. Particles of $Al_2O_3$, e.g., tend to become densified (less porous) when heated at very high temperatures, especially above about 1000°-1200° C.; these densified particles, being almost like a ceramic material may not imbibe much of the molten metal, so the metal collects mainly on the surface of the particles. cles.

Injectable reagents made in accordance with the present invention offer distinct advantages over the use of mere physical mixtures of metal particles and inorganic particles, e.g., lack of segregation during storage, handling, shipping, more efficient desulfurizing, better batch-to-batch conformity, and fewer off-spec process metals.

The following examples illustrate various embodiments, but the present invention is not limited to the particular embodiments illustrated. In the examples, all "parts" and percentages are by weight unless noted otherwise.

EXAMPLE 1

Magnesium-Impregnated Lime

In an argon atmosphere 20 parts by weight of Mg metal powder is uniformly blended with 40 parts by weight of dry calcined CaO. The blended mixture is placed in a ceramic vessel and placed in an argon-purged oven preheated to 800°-900° C. and heated for about 10 minutes, thereby melting the Mg powder whereupon it "soaks" into the CaO particles. The particles are removed from the oven and cooled in an argon atmosphere. At ambient temperature the particles are easily handled in ambient air; clusters of particles are easily broken apart as demonstrated by using a mortar and pestle. Because of having been uniformly blended prior to the melting of the Mg powder, the product is substantially homogeneous, that is, each particle is substantially of the same composition as the other particles. By having the oven preheated to 800°-900° C., one obtains quicker melting of the Mg metal powder than if the oven is operated at, say, 650°-750° C.

An operable, but less homogeneous product is prepared in a process wherein molten Mg is added, with mixing, into the calcined CaO, because the molten Mg soaks into some of the CaO particles before there is an opportunity for it to be uniformly distributed throughout the particles and an extensive mixing period is needed to more thoroughly distribute the molten Mg so as to more closely approach homogeniety.

Furthermore, if one adds CaO particles into molten Mg metal, then at the outset at least, there is, in the mixing vessel, a large excess of molten Mg for the amount of CaO added. This tends to cause the CaO and Mg to react and form a significant amount of MgO and Mg.Ca alloy. The present invention effectively avoids that by using techniques wherein the amount of CaO is always greater than the amount of Mg metal.

EXAMPLE 2

Magnesium-Impregnated Calcium Carbide

In an ambient laboratory atmosphere 20 parts of Mg metal powder is uniformly blended with 40 parts of $CaC_2$ (−300 mesh) and the blend is placed into an oven preheated to 800°-900° C. thereby melting the Mg whereupon it is imbibed by the $CaC_2$. After about ten minutes it is removed from the oven and cooled. Any clusters or bumps formed are easily broken into a powder using a mortar and pestle.

It is notable that when $CaC_2$ is used and oxide-containing reagents are not used, the need for an argon purge to exclude air is substantially obviated, because oxides (e.g. CaO) tend to promote the oxidation of Mg metal (when hot or molten), thus upsetting the targeted amount of Mg in the final injectable reagent, giving rise to increased amounts of MgO. However, any MgO present in the mixture can function as part of the inorganic reagent portion of the injectable reagent.

EXAMPLE 3

Magnesium-Impregnated $CaC_2$

In accordance with the method of Example 2, 20 parts of Mg powder are used with 60 parts of the particulate $CaC_2$ to make an injectable reagent. The results are essentially the same except that here the Mg comprises about 25% of the total as compared to about 33% of the total in Example 2.

EXAMPLE 4

Magnesium-Impregnated MgO

In accordance with the procedure followed in Example 1 above, about 12 parts of Mg powder are used with about 35 parts of particulate MgO, using an argon atmosphere to produce an injectable reagent. When cooled to room temperature the product can be handled in regular ambient air. Clusters are broken up with a mortar and pestle.

EXAMPLE 5

Magnesium-Impregnated Calcium Aluminate

Following the procedure of Example 2, using "regular" ambient air as the atmosphere, about 27 parts of Mg powder and about 80 parts of particulate calcium aluminate, $CaAl_2O_4$, are used in making an injectable reagent. Clusters are broken up with a mortar and pestle.

EXAMPLE 6

Mg-Impregnated $Al_2O_3$

Following the procedure of Example 2, using ambient atmosphere, 30 parts of Mg powder and 90 parts of $Al_2O_3$ powder are used in making an injectable reagent. Product is easily handled in regular ambient air. Clusters are more difficult to break apart, apparently because the $Al_2O_3$ had very little porosity and much of the Mg was on the surface of the particles, adhering them.

EXAMPLE 7

Mg-Impregnated CaO/MgO (Dolime)

Following the procedure of Example 1, in argon, 20 parts of Mg powder and 60 parts of particulate dolime are used in making an injectable reagent. When cooled to room temperature the product can be handled in regular ambient air. Clusters are broken up with a mortar and pestle.

EXAMPLE 8

Mg-Impregnated CaO/$CaC_2$

Following the procedure of Example 1, in argon, 20 parts of Mg powder, 30 parts of dry-calcined, particulate CaO, and 30 parts of particulate $CaC_2$ (−300 mesh) are used in making an injectable reagent. The powder can be handled in regular air. Clusters are easily broken up using a mortar and pestle.

EXAMPLE 9

Mg-Impregnated CaO

This demonstrates that the present methods and products are not seriously affected by the presence of minor amounts of extraneous salts or other such ingredients. The particulate Mg used here is a salt-coated Mg granule such as is disclosed in U.S. Pat. No. 4,559,084. The salt-coated Mg granules (about 92 wt. % Mg) are of a size which will all pass through a 8 mesh screen.

Following the procedure of Example 1, in argon, 20 parts of the salt-coated Mg granules are used with about 60 parts of dry-calcined particulate CaO to successfully prepare an injectable reagent. The presence of the salt (mostly alkali metal halides) has no substantial effect on the operation of the process or on the use of the injectable reagent in treating a molten process metal. Too much salt can, however, increase the amount of splashing of the process metal.

EXAMPLE 10

Mg-Impregnated $CaC_2$

In the same manner as Example 9, but in regular air, 20 parts of the salt-coated Mg granules are successfully used with 60 parts of $CaC_2$ (−300 mesh) to make an injectable reagent.

EXAMPLE 11

Mg-Impregnated CaO/$CaC_2$

In the same manner as Example 9, using argon, 20 parts of the salt-coated Mg granules are successfully used with 30 parts of CaO and 30 parts of CaC2 to make an injectable reagent.

EXAMPLE 12

Mg-Impregnated CaO

This example demonstrates that the Mg may be in a form other than powder or granules.

In the same manner of Example 1, under argon, 20 parts of particulate scrap Mg metal (lathe shavings) are successfully used with 60 parts of dry-calcined particulate CaO to make an injectable reagent.

EXAMPLE 13

Mg-Impregnated CaO/$CaC_2$

In the same manner as Example 12, 20 parts of Mg shavings are successfully used with 30 parts of CaO and 30 parts of $CaC_2$ to make an injectable reagent.

EXAMPLE 14

Comparison With Prior Art Mg/CaO Blend

In a small-scale demonstration, comparative runs were made between injectable reagents of the present invention and a physical mixture of Mg powder/lime powder, representing commonly used prior art. The runs were performed by injecting the reagents through a lance, in a nitrogen gas, into a small ladle of molten steel. All 3 runs had about equal violence.

| Reagent | % Mg in Reagent | Relative[1] Desulfurization |
|---|---|---|
| Mg/CaO blend[2] | 30 | 45 |
| M.I.L.[3] | 30 | 60 |
| M.I.C.C.[4] | 30 | 90 |

[1]Relative efficiency of the desulfurization.
[2]An example of prior art blend of Mg powder and lime.
[3]Magnesium-impregnated-lime.
[4]Magnesium-impregnated-calcium carbide.

As shown above, the M.I.L. is almost 50% better than the prior art blend as a desulfurizing reagent and M.I.C.C. is as twice as efficient. Further, the M.I.L. and M.I.C.C. do not undergo segregation of Ca compound from the Mg metal during storage, shipping, or handling.

EXAMPLE 15

Comparison With Prior Art Mg/CaO Blend

In a large scale commercial-size ladle, using lance injection in nitrogen, a large number of tests were made so as to compare M.I.L. (Mg-impregnated-lime of the present invention) with a prior art blend of Mg/CaO. The reagents each contained about 25% by wt. of Mg metal. The average desulfurization efficiency was determined, along with the standard deviation.

| Reagent | Efficiency | Std. Deviation |
|---|---|---|
| Mg/CaO blend (prior art) | 39 | 19 |
| M.I.L. (present invention) | 61 | 9 |

This compares quite well with the efficiency results found in the small-scale demonstrations of the above example. The M.I.L. was about 50% better than the prior art blend and had much less deviation between runs.

We claim:

1. An injectable reagent for a molten ferrous metal, said reagent consisting essentially of a major amount of a particulate inorganic reagent said inorganic reagent being an aluminum compound or an alkaline earth metal compound, the particles of which are impregnated with a minor amount of a metal reagent selected from the group consisting of magnesium, magnesium alloys, aluminum, and aluminum alloys.

2. The injectable reagent of claim 1 wherein the said metal reagent comprises a positive amount of up to about 45% by weight of the total.

3. The injectable reagent of claim 1 wherein the said metal reagent comprises about 5% to about 40% of the total.

4. The injectable reagent of claim 1 wherein the metal reagent comprises about 25% to about 35% of the total.

5. The injectable reagent of claim 1 wherein the metal reagent comprises magnesium or magnesium alloy.

6. The injectable reagent of claim 1 wherein the inorganic reagent comprises at least one of the group consisting of CaO, $CaC_2$, MgO, $CaAl_2O_4$, $Al_2O_3$, and mixtures of these.

7. The injectable reagent of claim 1 wherein the inorganic reagent comprises CaO, $CaC_2$, MgO, $CaAl_2O_3$, a mixture of CaO/MgO, or a mixture of CaO/$CaC_2$.

8. The injectable reagent of claim 1 wherein the inorganic reagent comprises CaO, $CaC_2$, a mixture of CaO/MgO, or a mixture of CaO/$CaC_2$.

* * * * *

UNITED STATES PATENT AND TRADEMARK OFFICE

CERTIFICATE OF CORRECTION

PATENT NO. : 4,765,830

DATED : August 23, 1988

INVENTOR(S) : Edward J. Skach, Jr; David W. Brake & Joseph H. Waibel

It is certified that error appears in the above-identified patent and that said Letters Patent is hereby corrected as shown below:

Col. 2, line 12, "inorgaric" should be --inorganic--.

Col. 3, line 20, "inorgaric" should be --inorganic--.

Col. 5, line 14, "fereably" should be --ferably--.

Col. 5, line 26, "cles." should be deleted.

Col. 10, line 6, "$CaAl_2O_3$," should read --$CaAl_2O_4$, $Al_2O_3$--.

Signed and Sealed this

Twenty-first Day of March, 1989

*Attest:*

DONALD J. QUIGG

*Attesting Officer*

*Commissioner of Patents and Trademarks*